US012108814B2

(12) United States Patent
Ichigaya et al.

(10) Patent No.: US 12,108,814 B2
(45) Date of Patent: Oct. 8, 2024

(54) GARMENT BODY OF FAN-EQUIPPED GARMENT AND FAN-EQUIPPED GARMENT

(71) Applicant: SFT LABORATORY CO., LTD., Tokyo (JP)

(72) Inventors: Hiroshi Ichigaya, Tokyo (JP); Takeo Kurumizawa, Tokyo (JP); Yohei Oki, Tokyo (JP); Naokatu Furuya, Tokyo (JP); Hidehito Nakanishi, Tokyo (JP); Shohji Inomata, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 66 days.

(21) Appl. No.: 17/773,459

(22) PCT Filed: Oct. 16, 2020

(86) PCT No.: PCT/JP2020/039100
§ 371 (c)(1),
(2) Date: Apr. 29, 2022

(87) PCT Pub. No.: WO2021/085185
PCT Pub. Date: May 6, 2021

(65) Prior Publication Data

US 2022/0386712 A1 Dec. 8, 2022

(30) Foreign Application Priority Data

Oct. 31, 2019 (JP) ..... 2019-198625

(51) Int. Cl.
*A41D 13/00* (2006.01)
*A41D 1/00* (2018.01)
(Continued)

(52) U.S. Cl.
CPC ..... *A41D 13/0053* (2013.01); *A41D 1/002* (2013.01); *A41D 27/28* (2013.01)

(58) Field of Classification Search
CPC ..... A41D 13/0053; A41D 1/002; A41D 27/28
See application file for complete search history.

(56) References Cited

U.S. PATENT DOCUMENTS 3,769,972 A * 11/1973 Saint-Martin ..... A61G 10/005 976/DIG. 336
6,082,443 A * 7/2000 Yamamoto ..... F28D 15/046 174/15.2

(Continued)

FOREIGN PATENT DOCUMENTS

JP 2006307354 A 11/2006
NO 2005063065 A1 7/2005

OTHER PUBLICATIONS

International Search Report (ISR) (and English translation thereof) dated Dec. 28, 2020, issued in International Application No. PCT/JP2020/039100.

(Continued)

*Primary Examiner* — Richale L Quinn
(74) *Attorney, Agent, or Firm* — Holtz, Holtz & Volek PC

(57) ABSTRACT

A main garment body is formed using a cloth that is gas-impermeable or is gas-permeable to the extent that the cloth can be inflated by the introduction of air by a ventilator. The garment body includes a connector to which the ventilator is attached, an air outlet that discharges air introduced by the ventilator, and a spacer member that keeps a space between the garment cloth and a body of a wearer and/or between the garment cloth and other clothes worn over the garment body.

2 Claims, 3 Drawing Sheets

(51) Int. Cl.
*A41D 13/005* (2006.01)
*A41D 27/28* (2006.01)

(56) References Cited

U.S. PATENT DOCUMENTS 6,823,678 B1 * 11/2004 Li ..... F25B 21/04 62/3.5
6,927,316 B1 * 8/2005 Faries, Jr. ..... A61F 15/006 602/14
7,117,687 B2 * 10/2006 Naaman ..... A41D 13/0025 62/3.5
7,721,349 B1 * 5/2010 Strauss ..... A43B 1/0072 450/38
8,281,609 B1 * 10/2012 Rothschild ..... A41D 13/0053 62/259.3
8,359,871 B2 * 1/2013 Woods ..... H10N 10/13 62/3.2
8,397,518 B1 * 3/2013 Vistakula ..... A61F 7/02 62/3.5
9,545,286 B2 * 1/2017 Rose ..... F28F 13/10
10,306,934 B2 * 6/2019 Ichigaya ..... A42B 3/003
10,426,204 B2 * 10/2019 Squires ..... A41D 13/0025
10,731,665 B2 * 8/2020 Ichigaya ..... F04D 29/601
10,760,591 B2 * 9/2020 Ichigaya ..... A47C 7/744
11,051,563 B2 * 7/2021 Kittaka ..... F04D 29/601
11,219,251 B2 * 1/2022 Ichigaya ..... A41D 13/0025
11,432,597 B2 * 9/2022 Temeng ..... A41D 13/0025
11,771,587 B1 * 10/2023 Maunder ..... A61F 7/007 607/96
11,819,074 B2 * 11/2023 Takahashi ..... A41D 1/002
2002/0170309 A1 * 11/2002 Strauss ..... F24F 5/0035 62/259.3
2004/0083526 A1 * 5/2004 Ichigaya ..... A41D 13/0025 2/2.14
2004/0168459 A1 * 9/2004 Blackstone ..... B60H 1/3235 2/DIG. 1
2006/0026743 A1 * 2/2006 Farnworth ..... A41D 31/145 2/455
2006/0080987 A1 * 4/2006 Ichigaya ..... A41D 13/0025 62/304
2006/0260183 A1 * 11/2006 Hockaday ..... A01M 1/02 43/132.1
2007/0050878 A1 * 3/2007 Ichigaya ..... A41D 13/0025 2/69
2007/0199124 A1 * 8/2007 Horn ..... A41D 13/0025 2/69
2007/0271939 A1 * 11/2007 Ichigaya ..... A41D 13/0025 62/259.3
2009/0145936 A1 * 6/2009 Convents ..... D06F 59/02 223/66
2010/0242147 A1 * 9/2010 Pohr ..... A41D 13/0025 2/69
2013/0319031 A1 * 12/2013 Coats, IV ..... A41D 13/0025 165/46
2016/0270457 A1 * 9/2016 Chen ..... A41D 13/0025
2017/0135419 A1 * 5/2017 Ichigaya ..... A41D 1/002
2018/0180345 A1 * 6/2018 Zhu ..... F25D 17/065
2019/0166928 A1 * 6/2019 Miwa ..... F04D 17/16
2019/0239578 A1 * 8/2019 Ichigaya ..... F24F 1/04
2020/0046050 A1 * 2/2020 Rusch ..... A41D 13/0025
2020/0359715 A1 * 11/2020 Tokunaga ..... A41D 13/0025
2021/0120890 A1 * 4/2021 Tokunaga ..... A41D 27/28
2021/0195973 A1 * 7/2021 Ichigaya ..... A41D 27/10
2021/0386129 A1 * 12/2021 Ichigaya ..... A41D 13/0025
2021/0392962 A1 * 12/2021 Matsui ..... F04D 29/646
2022/0142278 A1 * 5/2022 Takahashi ..... A41D 27/28
2022/0218060 A1 * 7/2022 Yamauchi ..... A41D 27/28
2022/0295917 A1 * 9/2022 Ichigaya ..... F04D 27/00
2022/0312862 A1 * 10/2022 Kano ..... A41D 13/0025
2022/0386712 A1 * 12/2022 Ichigaya ..... A41D 1/002
2022/0408856 A1 * 12/2022 Katsuta ..... A41D 13/0025
2023/0148688 A1 * 5/2023 Ichigaya ..... A41D 27/28 2/69
2023/0263244 A1 * 8/2023 Mateu Codina ... A41D 13/0053 2/69

OTHER PUBLICATIONS

Written Opinion dated Dec. 28, 2020, issued in International Application No. PCT/JP2020/039100.
International Preliminary Report on Patentability (IPRP) (and English language translation thereof) dated May 3, 2022, Issued in International Application No. PCT/JP2020/039100.

* cited by examiner

GARMENT BODY OF FAN-EQUIPPED GARMENT AND FAN-EQUIPPED GARMENT

TECHNICAL FIELD

The present invention relates to a fan-equipped garment and a garment body of a fan-equipped garment.

BACKGROUND ART

In recent years, a fan-equipped garment that cools a body has been put into practical use and is rapidly becoming widespread.

The fan-equipped garment includes:

a garment body made of a material with low breathability;

two fans attached to a lower part of the garment body on the back side;

a power source that supplies power to the two fans; and a power cable that electrically connects the power source with the two fans.

When the fans are activated, the fans take a large amount of air into the garment body. Pressure of the air taken in automatically creates an air flow passage between the garment body and a wearer's body. The air taken in flows along the surface of the wearer's body or underwear through the formed air flow passage, and is discharged to the outside through air outlets formed in openings of the collar and sleeves, for example.

The taken-in air evaporates sweat on the wearer's body while flowing through the air flow passage between the garment body and the wearer's body or underwear. Heat of vaporization generated by evaporating sweat cools the body (see, for example, Patent Literature 1).

CITATION LIST

Patent Literature

Patent Literature 1: WO 2005/063065 A

SUMMARY OF INVENTION

Technical Problem

For example, if you want to prevent people around you from knowing that you are wearing a fan-equipped garment, you may have to wear some other clothes over the fan-equipped garment.

However, when other clothes are worn over a conventional fan-equipped garment, an air inlet passage on the outer side of a fan is blocked. This prevents introduction of air into the garment body. If clothes to be worn over the fan-equipped garment are somewhat heavy, the fan-equipped garment is pressed against a wearer's body due to the weight. This prevents formation of an air flow passage inside the fan-equipped garment. Thus, it has been difficult to make the fan-equipped garment function well.

This is especially noticeable when wearing a garment with a protective function for a wearer's body such as a stab-proof garment or a bullet-proof garment, which is heavier than ordinary clothes such as a coat, over a fan-equipped garment.

A similar problem arises when non-clothing items are worn over a fan-equipped garment. For example, this is particularly noticeable when a worker engaged in high altitude work wears a safety harness or a backpack over a fan-equipped garment.

An object of the present invention is to provided a fan-equipped garment and a garment body of a fan-equipped garment whose function is hardly degraded even when worn under other clothes or the like.

Solution to Problem

A first aspect of the invention is a garment body of a fan-equipped garment, the garment body being constituted by garment cloth that is not breathable or has breathability to an extent that the garment cloth can be inflated by introduction of air by a ventilator, and including: a connector to which the ventilator is attached; an air outlet that discharges air introduced by the ventilator; and a spacer member that keeps a space between the garment cloth and a wearer's body and/or between the garment cloth and other clothes worn over the garment body.

According to a second aspect of the invention, the spacer member includes: a mesh member connected to the garment cloth; and a spacer provided in a space between the mesh member and the garment cloth.

According to a third aspect of the invention, the spacer member includes an outer spacer member that covers the connector and the garment cloth around the connector from an outer side of the garment body.

According to a fourth aspect of the invention, the connector consists of a plurality of connectors, and the outer spacer member covers all of the plurality of connectors.

According to a fifth aspect of the invention, the outer spacer member is provided around a bottom of the garment body.

According to a sixth aspect of the invention, the spacer member further includes a back inner spacer member on an inner side of a back part of the garment body.

According to a seventh aspect of the invention, the back inner spacer member extends over shoulders of the wearer on the inner side of the garment body.

According to an eighth aspect of the invention, the spacer member further includes a front inner spacer member on an inner side of a front part of the garment body.

According to a ninth aspect of the invention, the front inner spacer member extends over shoulders of the wearer on the inner side of the garment body.

A tenth aspect of the invention is a fan-equipped garment including the garment body of the fan-equipped garment; the ventilator that introduces air inside the garment body of the fan-equipped garment; and a power source that supplies power to the ventilator.

The present invention provides a fan-equipped garment and a garment body of a fan-equipped garment whose function is hardly degraded even when worn under other clothes or the like.

DESCRIPTION OF EMBODIMENTS

Hereinafter, embodiments of the present invention will be described with reference to FIGS. 1 to 4. The scope of the claims of the present invention is not limited to the illustrated examples. Various changes may be made to the embodiments described below within the scope of the claims of the present invention.

In the following explanation, the front, back, top, bottom, right and left correspond to those of a wearer of a fan-equipped garment 100, respectively.

I. Configuration of Embodiment

Figure 1:
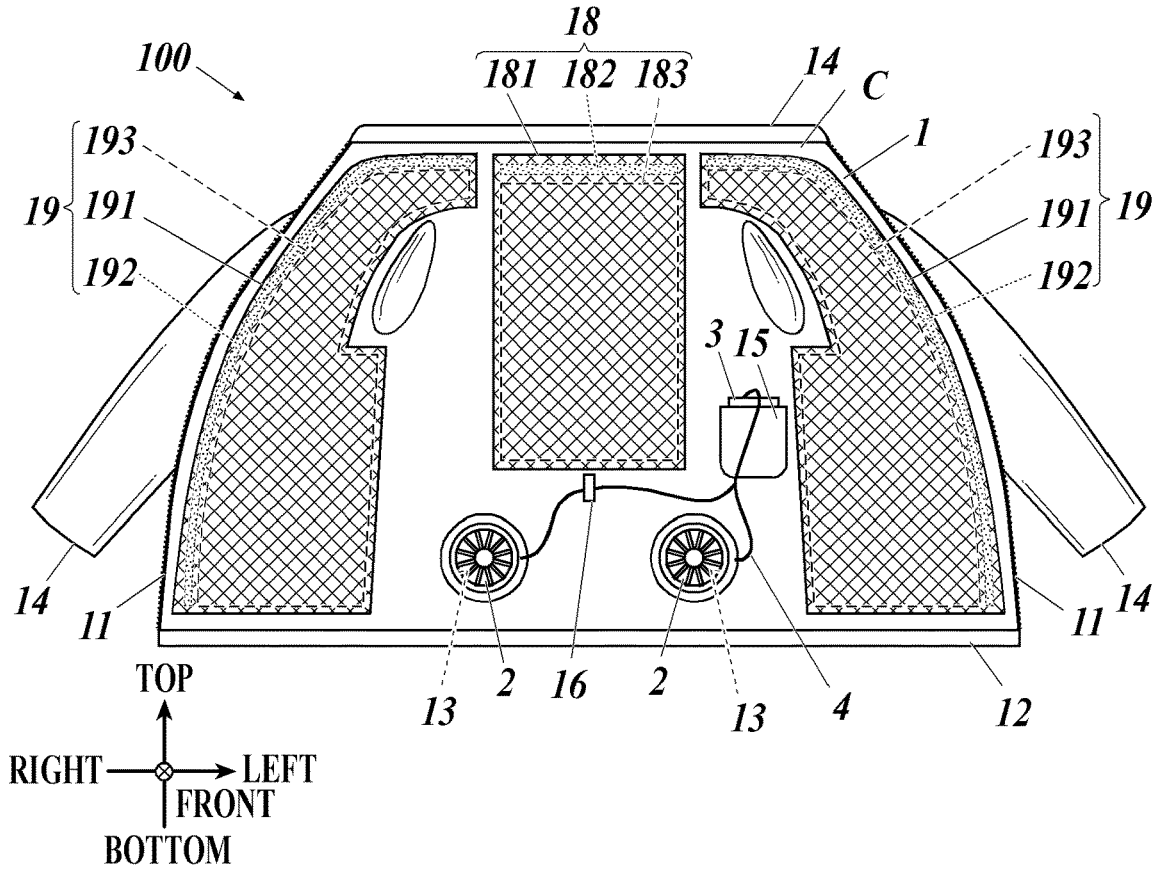
FIG. 1 shows a front view of a fan-equipped garment of an embodiment with a fastener being opened.

As shown in FIG. 1, the fan-equipped garment 100 according to an embodiment includes:

a garment body 1;

fans 2 that introduce air into the garment body 1;

a power source 3 that supplies power to the fans 2; and a connection cable 4 that connects the power source 3 with the fans 2.

The fans draw air into the garment body 1. The fan-equipped garment 100 circulates air along a surface of a body or underwear of a wearer, and then discharges the air through air outlets 14 formed in the collar and sleeves of the garment body 1. This evaporates sweat on the body. Heat of vaporization generated by evaporating sweat cools the body.

1. Garment Body

Figure 2:
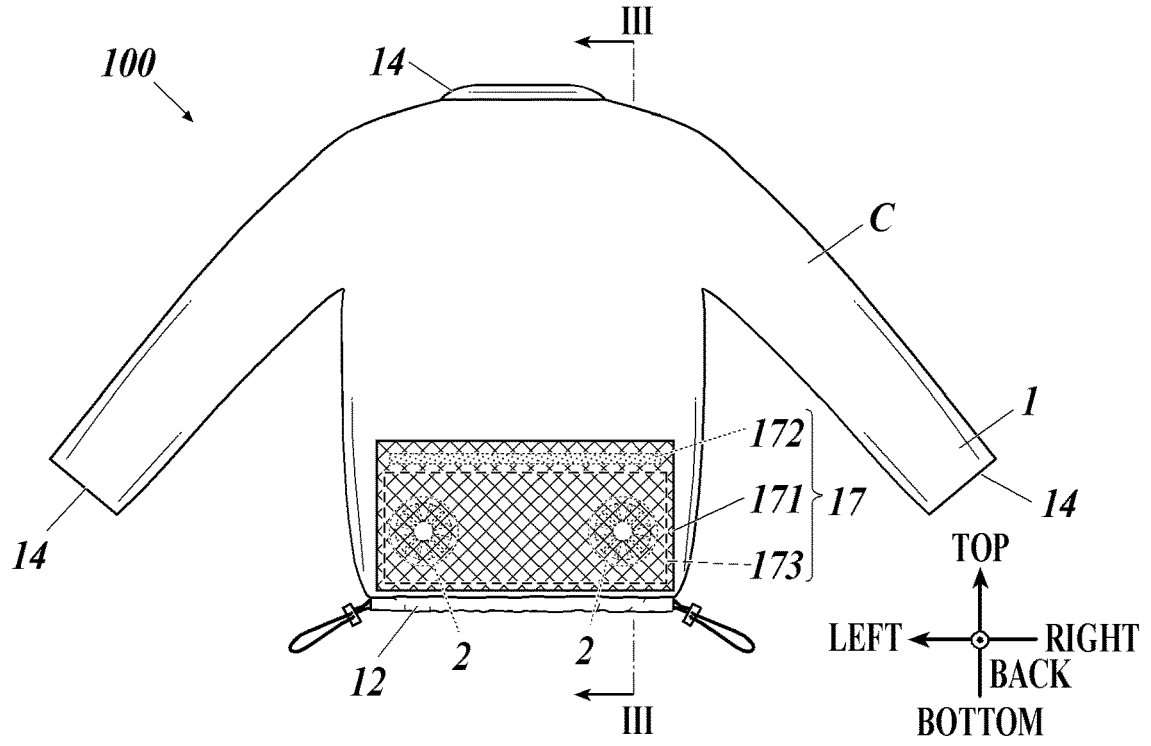
FIG. 2 shows a rear view of the fan-equipped garment of the embodiment with the fastener being closed.
Figure 3:
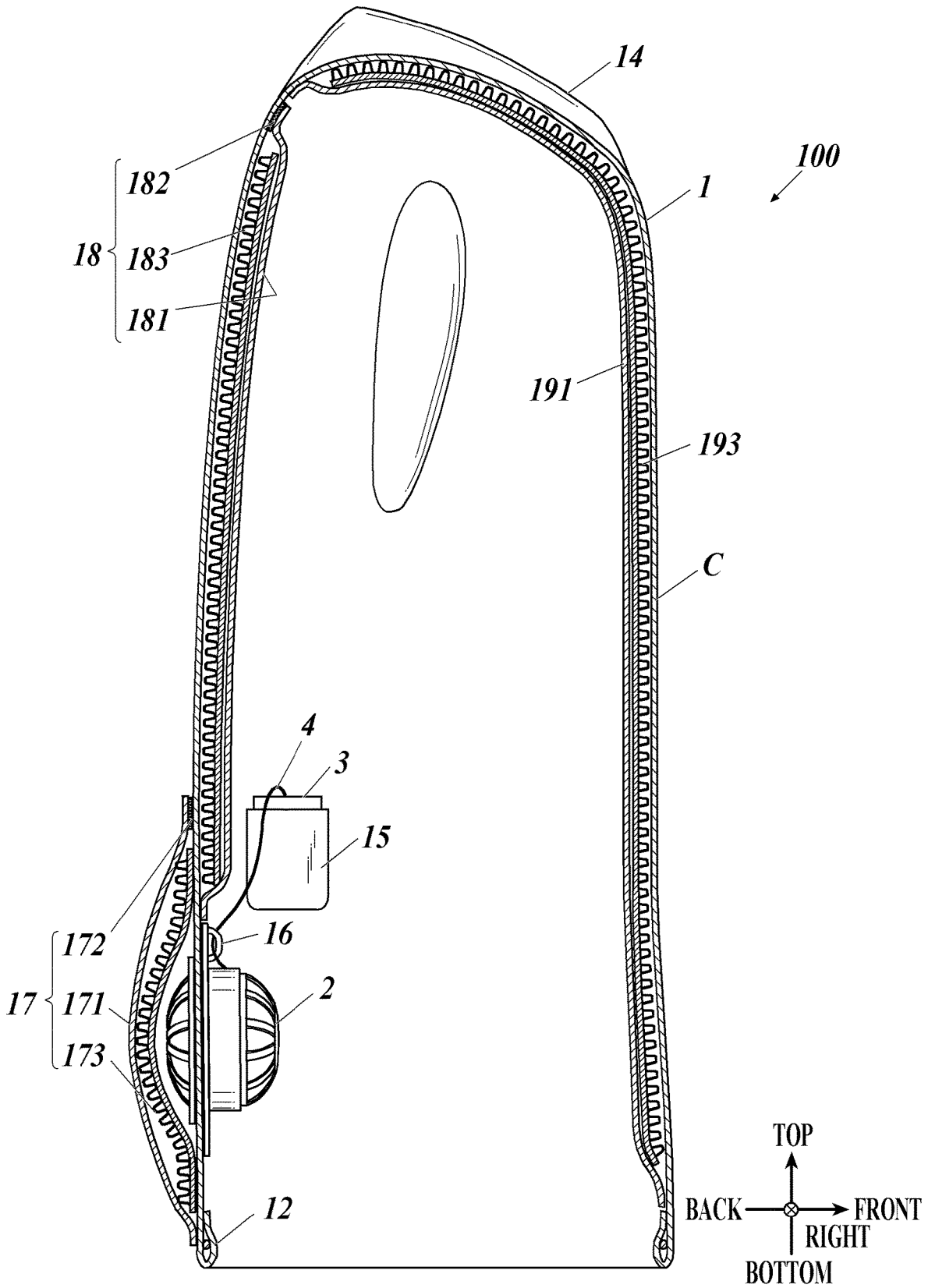
FIG. 3 is a cross-sectional view taken along the line III-III in FIG. 2.

As shown in FIGS. 1 to 3, the garment body 1 is constituted by garment cloth C and is formed in a shape that covers a wearer's trunk and arms. The garment cloth C is not breathable or has breathability to an extent that the garment cloth C can be inflated by introduction of air by the fans 2. In FIGS. 1 to 3, the garment body 1 is formed in a shape of a blouson. The shape of the garment body 1 is not limited to this as long as it covers at least a part of a wearer's body. For example, the shape of the garment body 1 can be a vest type that covers only the trunk of a wearer, or a coveralls type that covers the lower half of a wearer's body. The shape of the garment body 1 can be determined according to objects to be worn over a fan-equipped garment.

An inner surface of the garment cloth C is a surface of the garment cloth C which faces a wearer when the garment body 1 is worn. An outer surface of the garment cloth C is the surface on the opposite side, and is a surface facing the outside when the garment body 1 is worn. When the garment body 1 is worn, the inner surface of the garment cloth C as well as portions on the side of a wearer is on the inner side of the garment body 1. When the garment body 1 is worn, the outer surface of the garment cloth C as well as portions outside the garment cloth C is on the outer side of the garment body 1.

As shown in FIGS. 1 to 3, the garment body 1 includes a fastener 11, an air seal 12, a fan mount hole 13, an air outlet 14, a power source holder 15, a cable holder 16, an outer spacer member 17, a back inner spacer member 18, and a front inner spacer member 19. Air taken in by the fans 2 through the fan mount holes 13 is discharged from the air outlets 14 formed at the collar and sleeves.

(1) Fastener

The fastener 11 is used to open and close the front part of the garment body 1 when the fan-equipped garment 100 is put on. As shown in FIG. 1, the fastener 11 is mounted on edges of a divided portion in the front part of the garment body 1. The edges of the divided portion can be connected and separated. For example, a zipper is used as the fastener 11.

(2) Air Seal

As shown in FIGS. 1 to 3, the air seal 12 is at the bottom of the garment body 1, and prevents air in a space between the garment body 1 and a wearer's body from leaking outside through the hem of the garment body 1.

For example, the air seal 12 includes:

a cord loop wound around a body of a wearer at the hem of the garment body 1 except for the vicinity of the fastener 11;

a cord member passing through the cord loop; and a cord stopper provided in a portion of the cord member which comes out of the cord loop.

The cord stopper is fixed after pulling the portion of the cord member which comes out of the cord loop. This makes the hem of the garment body 1 adhere to a wearer's body.

When the fan-equipped garment 100 is worn, the hem of the garment body 1 is narrowed by the air seal 12 and adheres to a wearer's body. This prevents air from leaking out through the bottom of the garment body 1.

(3) Fan Mount Hole

As shown in FIG. 1, the fan mount holes 13 are circular holes formed in the garment cloth C constituting the garment body 1 at positions corresponding to right and left portions of a waist of a wearer. The fan mount hole 13 connects the space between the garment body 1 and a wearer's body with the outside of the garment body 1 while the fan-equipped garment 100 is worn.

The diameter of the fan mount hole 13 is substantially the same as the diameter of the fan 2 described below. The fan 2 is mounted so as to pass through the fan mount hole 13. Air is taken into the garment body 1 from the outside through the fan mount hole 13.

For example, the rim of the fan mount hole 13 should be reinforced by:

attaching a flat annular member made of plastic or the like; or folding and sewing the garment cloth C of the garment body 1 around the fan mount hole 13.

(4) Air Outlet

The fans 2 introduce air into the space between the garment body 1 and a wearer through the fan mount holes 13. The air outlets 14 are openings that discharge the air after the air flows along a body or underwear of a wearer.

As shown in FIGS. 1 to 3, the air outlets 14 are formed at:

an opening between a neck of a wearer and an edge of the collar of the garment body 1; and openings between arms of a wearer and edges of sleeves of the garment body 1.

(5) Power Source Holder

The power source holder 15 holds the power source 3 at a position where the power source 3 can supply power to the fan 2 through the connection cable 4. For example, as shown in FIGS. 1 and 3, the power source holder 15 is a pocket on the inner side of the garment body 1 and can hold the power source 3. Although the power source holder 15 is the pocket on the inner side of the garment body 1 in FIGS. 1 and 3, the power source holder 15 can have any specific configuration including this as long as the power source holder 15 can hold the power source 3 at a position where the power source 3 can supply power to the fan 2 through the connection cable 4.

For example, the power source holder 15 and a remote control holder (not shown) that holds a remote control (not shown) that controls the power source 3 may be provided on the outer side of the garment body 1. The connection cable 4 connects the fan 2 with the power source 3 (and the remote control) through an opening in the garment cloth C which opens to the outer side of the garment body 1 from the inner side of the garment body 1.

(6) Cable Holder

As shown in FIGS. 1 and 3, the cable holder 16 holds the connection cable 4 on the inner side of the garment body 1.

For example, a piece of cloth which is long in the vertical direction is sewn at two positions in the vertical direction like a common belt loop. Thus, the cable holder 16 is formed in a shape of a ring having an opening through which the connection cable 4 can pass. The cable holder 16 holds the connection cable 4 by passing the connection cable 4 through the opening.

(7) Outer Spacer Member

The outer spacer member 17 covers the fan mount hole 13 and the surrounding garment cloth C on the outer side of the back part of the garment body 1. The outer spacer member 17 ensures that, when clothes are worn over the fan-equipped garment 100, the distance between the clothes and the fan 2 and the part of the garment cloth C around the fan mount hole 13 is not shorter than the thickness of the spacer 173. The outer spacer member 17 keeps a space for directing air taken into the garment body 1 by the fan 2 to the fan 2 between the clothes and the fan 2 and the part of the garment cloth C around the fan mount hole 13.

As shown in FIGS. 2 and 3, the outer spacer member 17 includes:

- a mesh member 171 which is fixed to the garment cloth C on the outer side of the back part of the garment body 1 at edges of the mesh member 171 other than the upper edge;
- a fastener 172 which is provided at an opening between the upper edge of the mesh member 171 and the garment cloth C of the garment body 1 and which allows the opening to be freely closed and opened; and
- the spacer 173 stored in the space between the mesh member 171 and the garment cloth C of the garment body 1.

Mesh Member

As shown in FIGS. 2 and 3, the mesh member 171 is a substantially rectangular mesh member attached to the outer side of the garment cloth C of the garment body 1 to cover both of the two fan mount holes 13. As shown in FIG. 2, the mesh member 171 is placed on the outer side of the garment cloth C to cover both of the two fan mount holes 13, and then fixed to the garment cloth C at the left and right edges and the lower edge of the mesh member 171 by sewing, gluing, or other methods. Thus, the mesh member 171 is joined to a portion of the garment cloth C which is around the bottom of the back part of the garment body 1.

This forms a bag space with an opening at the top between the garment cloth C and the mesh member 171.

The mesh member 171 may have any specific configuration as long as each pore of the mesh is small enough that the spacer 173 cannot pass through it and is sufficiently opened to introduce air to the fan 2 through the spacer 173. Any material can be used as long as the mesh member 171 is strong enough to prevent the spacer 173 from falling. The method of joining the mesh member 171 to the garment cloth C is not limited as long as the mesh member 171 does not come off due to the weight of the spacer 173.

The mesh member itself may be formed into a bag, and a fastener consisting of a hook-and-loop fastener or the like may be provided at an opening of the bag-shaped mesh member, so that a spacer described below can be removably stored in the bag. In this case, the mesh member can be detachably attached to the garment cloth C by means of the hook-and-loop fastener or the like.

Fastener

The fastener 172 allows opening and closing of the opening formed between the upper edge of the mesh member 171 and the garment cloth C. For example, as shown in FIGS. 2 and 3, one component of the hook-and-loop fastener extends in the left-right direction around the upper edge of the mesh member 171. The other component of the hook-and-loop fastener is attached to a part of the garment cloth C which is opposite to the one component of the hook-and-loop fastener. Thus, the vicinity of the upper edge of the mesh member 171 is enabled to be attached to and removed from the garment cloth C.

Spacer

The spacer 173 is a member with a space formed inside for circulation of air. As shown in FIGS. 2 and 3, the spacer 173 is stored in the space between the mesh member 171 and the garment cloth C of the garment body 1.

The spacer 173 may have any structure as long as the spacer 173 can keep a space for directing air drawn into the garment body 1 by the fan 2 to the fan 2, the space being between:

- clothes worn over the fan-equipped garment 100; and
- the fan 2 and the part of the garment cloth C around the fan mount hole 13.

Figure 4:
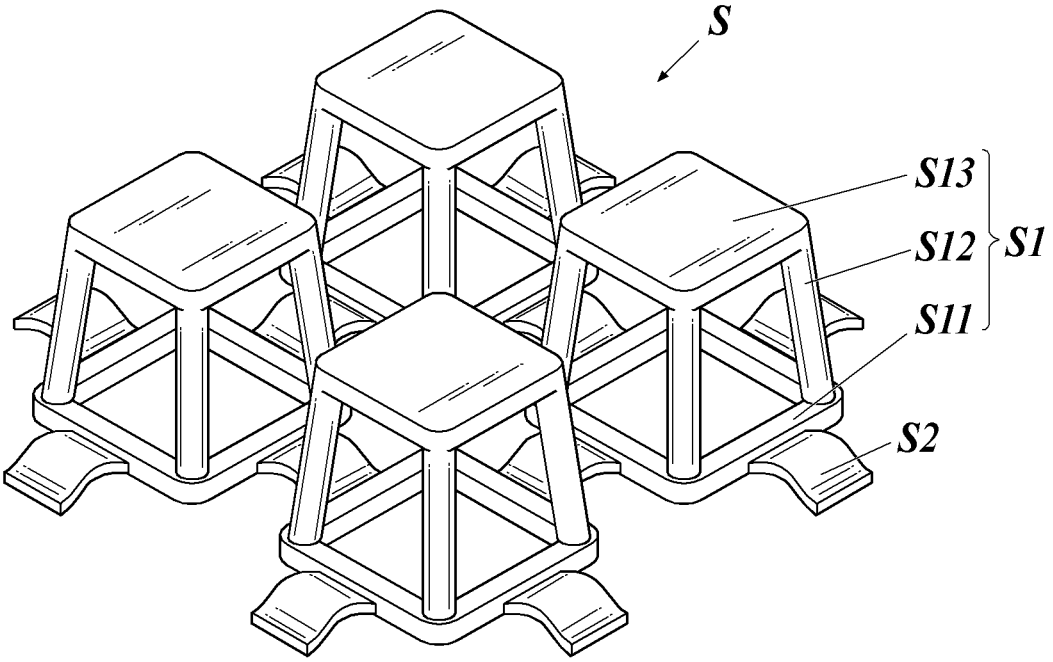
FIG. 4 shows a structure of a spacer used in the fan-equipped garment of the embodiment.

For example, the spacer structure S shown in FIG. 4, which is disclosed in Japanese Patent No. 4067034, can be used.

Specifically, the spacer structure S shown in FIG. 4 includes:

- a frame S11;
- a convex portion S1 that includes:
- four pillars each having one end connected to the frame S11 and rising from the frame S11; and
- a connection S13 that connects the other ends of the four pillars S12; and
- a flexible joint S2 that connects the frames S11 of adjacent convex portions S1.

The flexible joint S2 is formed as a strip that is thinner than the frame S11. This makes the spacer structure S easy to bend at the flexible joint S2 so that it has a certain flexibility.

According to the spacer structure S, a spacer of any size and shape can be formed by changing the number of convex portions S1 connected by the flexible joints S2.

The spacer structure S may be made of any material as long as it is strong enough to prevent the spacer structure S from being significantly deformed by the weight of clothes even when, for example, a garment with a protective function such as a stab-proof garment or a bullet-proof garment, which is somewhat heavy, is worn over the fan-equipped garment 100. In view of comfort, it is preferable that the material is strong enough as described above, but not too hard. For example, polyethylene (PE) is preferred. Depending on load conditions, load direction and the weight of an object worn over the fan-equipped garment, more flexible elastomer (TPE) may be preferred. The material is not limited to them. If necessary, or depending on where they are put, multiple spacer structures S may be piled.

The spacer 173 is formed by the spacer structure S such that it is large enough to cover substantially the entire mesh member 171, except for the portion equipped with the fastener 172. The spacer 173 can be removed from the mesh member 171 via the fastener 172 of the mesh member 171.

In this embodiment, the spacer 173 is attached to the garment body 1 via the mesh member 171. Alternatively, the spacer 173 may be sewn directly to the garment cloth C, or may be detachably attached to the garment cloth C by means of a hook-and-loop fastener or the like. In this case, the mesh member 171 is not necessary.

(8) Back Inner Spacer Member

The back inner spacer member 18 is provided at a position above the fan mount hole 13 on the inner side of the back part of the garment body 1. Even when clothes are worn over the fan-equipped garment 100 and the weight of the clothes is applied to the fan-equipped garment 100, the back inner spacer member 18 ensures that the distance between the wearer's body and the garment cloth C of the back part of the garment body 1 does not become shorter than the thickness of a spacer 183. This keeps a space where air drawn into the garment body 1 by the fan 2 flows between the wearer's body and the garment cloth C of the back part of the garment body 1.

As shown in FIGS. 1 and 3, on the inner side of the garment body 1, the back inner spacer member 18 includes:

- a mesh member 181 which is fixed to the garment cloth C at edges of the mesh member 181 other than the upper edge;
- a fastener 182 which is provided at an opening between the upper edge of the mesh member 181 and the garment cloth C of the garment body 1 and which allows the opening to be freely closed and opened; and
- the spacer 183 stored in the space between the mesh member 171 and the garment cloth C of the garment body 1.

Mesh Member

As shown in FIGS. 1 and 3, the mesh member 181 is a substantially rectangular mesh member attached at a position above the fan mount hole 13 on the inner side of the garment cloth C of the garment body 1. As shown in FIG. 1, the mesh member 181 is placed at the position on the inner side of the garment cloth C, and then fixed to the garment cloth C at the left and right edges and the lower edge by sewing, gluing, or other methods. Thus, the mesh member 181 is joined to the position on the inner side of the garment cloth C.

This forms a bag space with an opening at the top between the garment cloth C and the mesh member 181.

The mesh member 181 may have any specific configuration as long as each pore of the mesh is small enough that the spacer 183 cannot pass through it and is sufficiently opened to let air flow inside the garment body 1 through the spacer 183. Any material can be used as long as the mesh member 181 is strong enough to prevent the spacer 183 from falling. The method of joining the mesh member 181 to the garment cloth C is not limited as long as the mesh member 181 does not come off due to the weight of the spacer 183.

The mesh member itself may be formed into a bag, and a fastener consisting of a hook-and-loop fastener or the like may be provided at an opening of the bag-shaped mesh member, so that a spacer described below can be removably stored in the bag. In this case, the mesh member can be detachably attached to the garment cloth C by means of the hook-and-loop fastener or the like.

Fastener

The fastener 182 allows opening and closing of the opening formed between the garment cloth C and the upper edge of the mesh member 181. For example, as shown in FIGS. 1 and 3, one component of the hook-and-loop fastener extends in the left-right direction around the upper edge of the mesh member 171. The other component of the hook-and-loop fastener is attached to a part of the garment cloth C which is opposite to the one component of the hook-and-loop fastener. Thus, the vicinity of the upper edge of the mesh member 181 is enabled to be attached to and removed from the garment cloth C.

Spacer

The spacer 183 is a member with a space formed inside for circulation of air. As shown in FIGS. 1 and 3, the spacer 183 is stored in the space between the mesh member 181 and the garment cloth C of the garment body 1.

The spacer 183 may have any structure as long as the spacer 183 can keep a space for circulation of air drawn into the garment body 1 by the fan 2 between the wearer's body and the garment cloth C of the back part of the garment body 1. In the same manner as described for the outer spacer member 17, the spacer 183 having the spacer structure S shown in FIG. 4 can be used.

The spacer 183 is formed by the spacer structure S such that it is large enough to cover substantially the entire mesh member 181, except for the portion equipped with the fastener 182. The spacer 183 can be removed from the mesh member 181 via the fastener 182 of the mesh member 181.

In this embodiment, the spacer 183 is attached to the garment body 1 via the mesh member 181. Alternatively, the spacer 183 may be sewn directly to the garment cloth C, or may be detachably attached to the garment cloth C by means of a hook-and-loop fastener or the like. In this case, the mesh member 181 is not necessary.

(9) Front Inner Spacer Member

The front inner spacer member 19 is provided on each of right and left sides of the fastener 11 on the inner side of the front part of the garment body. Even when clothes are worn over the fan-equipped garment 100 and the weight of the clothes is applied to the fan-equipped garment 100, the front inner spacer member 19 ensures that the distance between the wearer's body and the garment cloth C of the front part of the garment body 1 does not become shorter than the thickness of a spacer 193. This keeps a space where air drawn into the garment body 1 by the fan 2 flows between the wearer's body and the garment cloth C of the back part of the garment body 1.

As shown in FIGS. 1 and 3, on the inner side of the garment body 1, the front inner spacer member 19 includes:

- a mesh member 191 which is fixed to the garment cloth C at edges of the mesh member 191 other than the edge along the fastener 11;
- a fastener 192 which is provided at an opening between the edge of the mesh member 171 along the mesh member 191 and the garment cloth C of the garment body 1 and which allows the opening to be freely closed and opened; and
- a spacer 191 stored in the space between the mesh member 191 and the garment cloth C of the garment body 1.

As shown in FIGS. 1 and 3, the front inner spacer member 19 is in front of a wearer's trunk and extends over the wearer's shoulders when the garment body 1 is worn.

Mesh Member

As shown in FIGS. 1 and 3, the mesh member 191 is a mesh member attached to each of right and left sides of the fastener 11 on the inner side of the garment cloth C of the garment body 1. As shown in FIG. 1, the mesh member 191 is placed at the position on the inner side of the garment cloth C, and then fixed to the garment cloth C by sewing, gluing, or other methods, except for the edge along the fastener 11. Thus, the mesh member 191 is joined to the position on the inner side of the garment cloth C.

This forms a bag space with an opening along the fastener 11 between the garment cloth C and the mesh member 191.

The mesh member 191 may have any specific configuration as long as each pore of the mesh is small enough that the spacer 193 cannot pass through it and is sufficiently opened to let air flow inside the garment body 1 through the spacer 193. Any material can be used as long as the mesh member 191 is strong enough to prevent the spacer 193 from falling. The method of joining the mesh member 191 to the garment cloth C is not limited as long as the mesh member 191 does not come off due to the weight of the spacer 193.

The mesh member itself may be formed into a bag, and a fastener consisting of a hook-and-loop fastener or the like may be provided at an opening of the bag-shaped mesh member, so that a spacer described below can be removably stored in the bag. In this case, the mesh member can be detachably attached to the garment cloth C by means of the hook-and-loop fastener or the like.

Fastener

The fastener 192 allows opening and closing of the opening formed between the garment cloth C and the edge of the mesh member 191 along the fastener 11. For example, as shown in FIG. 1, one component of the hook-and-loop fastener extends along and near the edge of the mesh member 191. The other component of the hook-and-loop fastener is attached to a part of the garment cloth C which is opposite to the one component of the hook-and-loop fastener. Thus, the vicinity of the edge along the fastener 11 of the mesh member 191 is enabled to be attached to and removed from the garment cloth C.

Spacer

The spacer 193 is a member with a space formed inside for circulation of air. As shown in FIGS. 1 and 3, the spacer 193 is stored in the space between the mesh member 191 and the garment cloth C of the garment body 1.

The spacer 193 may have any structure as long as the spacer 193 can keep a space for circulation of air drawn into the garment body 1 by the fan 2 between the wearer's body and the garment cloth C of the front part of the garment body 1. In the same manner as described for the outer spacer member 17, the spacer 183 having the spacer structure S shown in FIG. 4 can be used.

The spacer 193 is formed by the spacer structure S such that it is large enough to cover substantially the entire mesh member 191, except for the portion equipped with the fastener 192. The spacer 193 can be removed from the mesh member 191 via the fastener 192 of the mesh member 191.

In this embodiment, the spacer 193 is attached to the garment body 1 via the mesh member 191. Alternatively, the spacer 193 may be sewn directly to the garment cloth C, or may be detachably attached to the garment cloth C by means of a hook-and-loop fastener or the like. In this case, the mesh member 191 is not necessary.

2. Fan

As shown in FIGS. 1 to 3, the fan 2 is attached to the garment body 1 through the fan mount hole 13. The fan 2 introduces air into the space between the garment body 1 and the wearer's body through the fan mount hole 13. The power source 3 supplies necessary power to the fan 2 through the connection cable 4.

The fan 2 may have any specific configuration as long as it can be attached to the garment body 1 through the fan mount hole 13 and can introduce air from the outer side to the inner side of the garment body 1.

3. Power Source

The power source 3 supplies power to the fan 2. For example, a lithium-ion battery with a safety protection circuit is built in the power source 3. As shown in FIG. 1, the power source 3 is connected to the fan 2 through the connection cable 4. The power source 3 includes a switch to turn on/off power supplied to the fan 2.

The power source 3 may have any specific configuration as long as the power source 3 can supply power to the fan 2.

4. Connection Cable

The connection cable 4 connects the power source 3 with the fan 2. The power source 3 supplies the fan 2 with power required for operating the fan 2 through the connection cable 4.

The connection cable 4 may have any specific configuration as long as the power source 3 can supply the fan 2 with power required for operating the fan 2.

II. Advantageous Effect of Embodiment

According to the fan-equipped garment 100 of the embodiment, on the outer surface of the back part of the garment body 1, the outer spacer member 17 is provided so as to cover the fan mount hole 13 and the surrounding garment cloth C.

As a result, even when other clothes are worn over the fan-equipped garment 100, the clothes do not adhere to the fan 2 attached to the fan mount hole 13 and the surrounding garment cloth C. Air is easily introduced from below the garment body 1 through the spacer 173 inside the outer spacer member 17. Even when other clothes or items are worn over the fan-equipped garment 100, the cooling function is prevented from declining.

The outer spacer member 17 is constituted by the single large spacer 173 so as to cover both of the two fans 2 and the surrounding garment cloth C. This widens the air flow passage on the outer side of the garment body 1, including the area between the two fans 2. This further enhances the advantageous effect.

The outer spacer member 17 extends to the vicinity of the bottom of the back part of the garment body 1. This further facilitates introduction of air below the garment body.

The fan-equipped garment 100 includes the back inner spacer member 18 and front inner spacer member 19. This prevents the space for air circulation in the fan-equipped garment 100 from being blocked by the garment cloth C adhering to a wearer's body due to the weight of other clothes when the clothes are worn over the fan-equipped garment 100. The cooling function is prevented from declining even when other clothes or items are worn over the fan-equipped garment 100.

The front inner spacer member 19 extends over shoulders of a wearer. This keeps a space for air circulation over shoulders of the wearer, where the weight of clothes are applied and the air flow passage is easily blocked, the space continuing from the front of the wearer. This further enhances the advantageous effect.

The outer spacer member 17, the back inner spacer member 18 and the front inner spacer member 19 are all attached such that the spacers are stored in the bag spaces formed by the mesh members. This facilitates removal of the spacers when, for example, the garment body 1 is washed.

III. Modification

As shown in FIGS. 1 and 3, according to the fan-equipped garment 100 of the embodiment, the front inner spacer member 19 extends over shoulders of a wearer on the inner side of the garment body 1. Alternatively, the back inner spacer member 18 may extend over shoulders of a wearer on the inner side of the garment body 1.

Alternatively, the back inner spacer member 18 and the front inner spacer member 19 may be connected above shoulders of a wearer. This forms one spacer that extends from the front part to the back part on the inner side of the garment body 1.

INDUSTRIAL APPLICABILITY

The present invention is suitably used in the field of manufacturing fan-equipped garments and garment bodies of fan-equipped garments.

REFERENCE SIGNS LIST

100 fan-equipped garment
1 garment body
13 fan mount hole (connector)
15 air outlet
17 outer spacer member (spacer member)
171 mesh member
173 spacer
18 back inner spacer member (spacer member)
181 mesh member
183 spacer
19 front inner spacer member (spacer member)
191 mesh member
193 spacer
2 fan (ventilator)
3 power source
4 connection cable (power source)
C garment cloth

The invention claimed is:

1. A garment body for a fan-equipped garment, the garment body being constituted by garment cloth that is not breathable or has breathability to an extent that the garment cloth can be inflated by introduction of air by a ventilator, and comprising:

a connector to which the ventilator is attachable;

an air outlet to discharge air introduced by the ventilator; and a spacer member that maintains a space between the garment cloth and a body of a wearer, wherein the spacer member comprises:

a mesh member connected to the garment cloth; and a spacer removably stored against the mesh member, and wherein the spacer comprises:

a back inner spacer provided on an inner side of a back part of the garment body, and adapted to extend from an upper part of the connector over at least a portion of shoulders of the wearer on an inner side of the garment body; and a front inner spacer provided on an inner side of a front part of the garment body, and adapted to extend from a front of the wearer's trunk over at least a portion of the shoulders of the wearer on the inner side of the garment body.

2. A fan-equipped garment, comprising:

the garment body according to claim 1;

the ventilator, which introduces air inside the garment body; and a power source that supplies power to the ventilator.

* * * * *